US006871573B2

(12) United States Patent
Mang

(10) Patent No.: US 6,871,573 B2
(45) Date of Patent: Mar. 29, 2005

(54) SAW CHAIN

(75) Inventor: Harald Mang, Winnenden (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 10/414,171

(22) Filed: Apr. 15, 2003

(65) Prior Publication Data

US 2003/0192418 A1 Oct. 16, 2003

(30) Foreign Application Priority Data

Apr. 15, 2002 (DE) ..... 102 16 529

(51) Int. Cl.[7] ..... B26B 1/46; B27B 33/14
(52) U.S. Cl. ..... 83/830; 83/834
(58) Field of Search ..... 83/830–834

(56) References Cited

U.S. PATENT DOCUMENTS 3,910,148 A * 10/1975 Weiss ..... 83/833
4,074,604 A * 2/1978 Goldblatt et al. ..... 83/830
4,133,239 A * 1/1979 Goldblatt ..... 83/834
4,353,277 A * 10/1982 Silvon ..... 83/833
4,425,830 A * 1/1984 Atkinson ..... 83/833
4,558,621 A * 12/1985 Nitschmann et al. ..... 83/834
4,562,762 A 1/1986 Dubler
4,756,221 A * 7/1988 Nitschmann et al. ..... 83/833
5,042,350 A * 8/1991 Nitschmann ..... 83/830
5,257,568 A * 11/1993 Nitschmann ..... 83/830
6,006,629 A * 12/1999 Löfgren ..... 83/833
6,223,640 B1 * 5/2001 Sündstrom ..... 83/830
6,435,070 B1 * 8/2002 Weber ..... 83/830

FOREIGN PATENT DOCUMENTS

DE 37 43 226 6/1989

* cited by examiner

*Primary Examiner*—Allan N. Shoap
*Assistant Examiner*—Jason Prone
(74) *Attorney, Agent, or Firm*—Robert W Becker & Associates; Robert W Becker

(57) ABSTRACT

A saw chain for a power chain saw is provided and comprises drive links and side links that connect them, whereby alternatingly disposed on one and the other longitudinal side of drive links, in place of a side link, are a cutter link and a leading safety link. The cutter link has a cutter tooth and a leading depth limiter, whereby the safety link is provided with a projecting nose for support against the base of a cut. The nose extends in the direction toward the depth limiter. The safety link is provided with a side portion disposed in front of the nose. The side portion has an elevated contact surface, which, when the saw chain is curved in the reversing region, is disposed on the path of a top cutting edge of the cutter tooth, and when the saw chain is extended reaches at least nearly to the height of the depth limiter.

15 Claims, 4 Drawing Sheets

SAW CHAIN

BACKGROUND OF THE INVENTION

The present invention relates to a chain for a power chain saw.

U.S. Pat. No. 4,562,762 discloses a saw chain for a power chain saw and comprises drive links, side links that connect them, as well as cutter links and guard links. In this connection, the cutter links and guard links are respectively alternatingly disposed on the longitudinal sides of the drive links, whereby in the direction of travel, the guard link is disposed ahead of the cutter link. The cutter link is provided on that surface thereof that faces the upper side of the chain with a curved contour that rises toward the cutter link with a nose that is formed on the end of the guard link and that when the saw chain is extended is disposed next to a depth limiter of the cutter link. In this connection, the outer end of the nose is disposed slightly below the upper point of the depth limiter, although the highest bulge of the guard link is disposed on the level of the depth limiter. In the curved state of the chain, the guard link is pivoted relative to the cutter link in such a way that in the region of the nose the outer contour of the guard link is disposed upon the path of the top cutting edge of the cutter link. With the known saw chain, no re-sharpening is provided, and such could not even be carried out economically since it is not possible to adapt the non-uniform curved contour of the guard link with simple means.

DE 37 43 226 A1 discloses a re-sharpened saw chain where guard or safety links are provided that precede the cutter tooth. These safety links are supported on the base of the cut via a nose-shaped projection. For this purpose, the safety link is provided with a nose that extends counter to the direction of travel toward the cutter tooth, with the nose overlapping the depth limiter of the cutter link. The nose is provided with a portion that drops off counter to the direction of travel, and that in the guide or reversing region is displaced onto the movement path.

It is therefore an object of the present invention to provide a saw chain with which it is possible to achieve a significantly improved result during the so-called plunging or cutting with the power chain saw.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
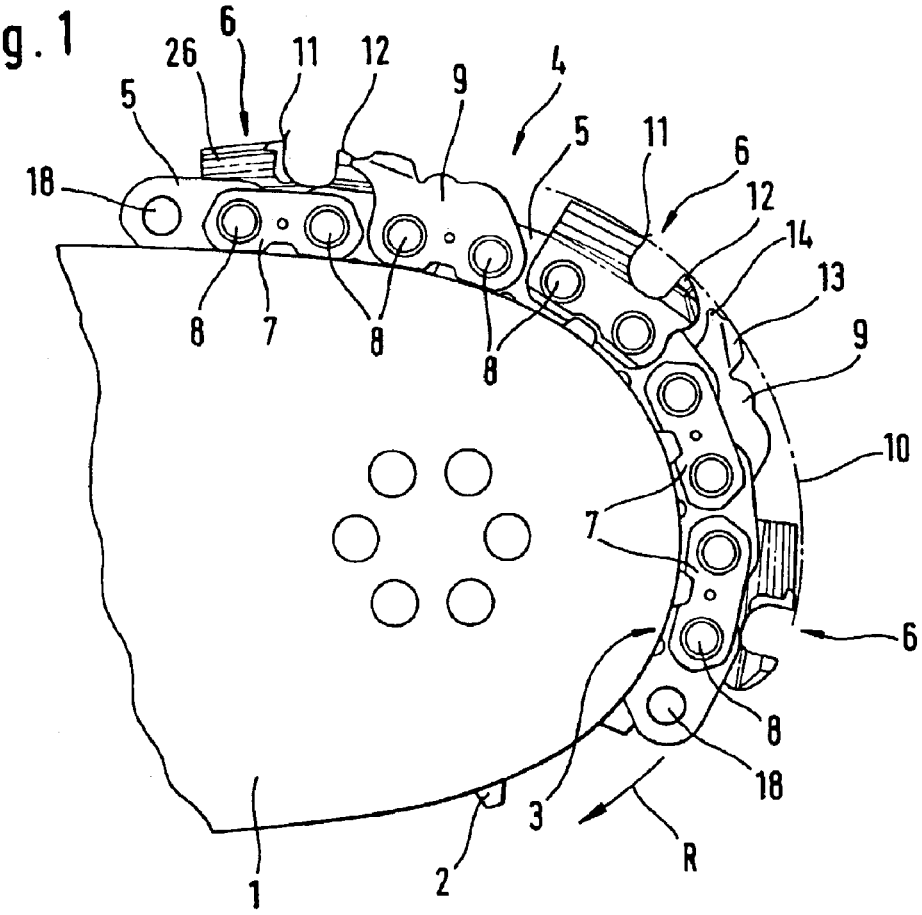
FIG. 1 shows the front end of a guide bar of a saw with a portion of one exemplary embodiment of an inventive saw chain.

The saw chain of the present invention is comprised of drive links and side links that connect the drive links, whereby a cutter link and a leading safety link are alternatingly disposed, in place of a side link, on one and the other longitudinal side of drive links, and the cutter link has a cutter tooth and a preceding depth limiter, whereby the safety link is provided with a projecting nose for support on the base of a cut, with the nose extending in the direction toward the depth limiter, the safety link is furthermore provided with a side portion that in the direction of travel of the saw chain is disposed ahead of the nose, and which has an elevated contact surface that, when the saw chain is curved in a reversing region, is disposed on the path of the top cutting edge of the cutter tooth, and that when the saw chain is extended, reaches at least nearly to the height of the depth limiter.

Pursuant to the configuration of the present invention, the side portion, in the new state of the saw chain, forms the contact surface at a higher level, and only in the sharpened state of the saw chain does the contact surface on the nose of the safety link lie upon the path of the re-sharpened top cutting edge. In this way, the operative or effective contact surface can be kept constant in the various stages of the re-sharpening. In this connection, it is expedient to have a large contact surface structurally available for each sharpening stage, whereby these surfaces can be placed in a radial position relative to the path of the top cutting edge that is favorable with regard to a cutting performance.

Pursuant to a preferred embodiment, when the saw chain is curved, the entire length of the contact surface is disposed at least nearly upon the path of the top cutting edge. Furthermore, it is expedient, when the saw chain is extended, that the front end of the contact surface, as viewed in the direction of travel, be disposed at the same height as the depth limiter. Also with this design a good cutting result is achieved.

Pursuant to a further embodiment of the invention, there is provided on the side portion, in front of the contact surface as viewed in the direction of travel, a guide surface for a re-sharpening tool. In this way, the re-sharpening of the depth limiter is simplified, and at the same time an adaptation of the contact surface is achieved. In front of the guide surface as viewed in the direction of travel, an indentation is preferably provided, so that the edge of the sharpening tool is free, and hence an optimal support of the sharpening tool upon the guide surface is ensured. As viewed in the longitudinal direction of the safety link, the indentation is preferably disposed nearly over the center point of a rear rivet-receiving opening.

Pursuant to a further embodiment of the invention, a transition region is provided between the contact surface and the nose. The effectiveness of this transition region is that during a later stage of the re-sharpening, another contact surface is formed on respective steps at the transition region and moves upon the path of the top cutting edge. Pursuant to another embodiment, a peak or crown can be formed. This crown operates in such a way that in the curved state of the saw chain, it is disposed somewhat beyond the path of the re-sharpened top cutting edge, and hence during the plunging or cutting with the power chain saw, this crown serves as a contact surface relative to the base of the groove.

At least one marking or indicator is expediently provided in the region of the side portion and/or on the lower border thereof; this indicator is, for example, embodied as a line that extends parallel to the guide surface. This indicator serves for establishing a specified magnitude of the re-sharpening, whereby with a plurality of indicators the various sharpening states can be recognized. It is expedient to embody the indicator in the manner of an embossment or relief in the material of the safety link.

Further specific features of the invention will be described in detail subsequently.

DESCRIPTION OF PREFERRED EMBODIMENTS

Referring now to the drawings in detail, FIG. 1 shows the front portion of a guide bar 1, which includes a guide or reversing region 3 in which is disclosed a guide star 2. Also illustrated is a portion of a saw chain 4, which is disposed upon the guide bar 1 and extends along the guide region 3. The saw chain 4 includes drive links 5 as well as cutter links 6, side or tie links 7 and safety links 9. The aforementioned links are hingedly or pivotably interconnected by means of rivets 8. Rivet receiving openings 18 can be seen on the respective first and last drive link 5 of the saw chain portion illustrated in FIG. 1.

Each of the cutter links 6 includes a cutter tooth 26 having a top cutting edge 11 and a leading depth gauge or limiter 12 as viewed in the direction of travel R. Disposed ahead of each cutter link 6, in the direction of travel R, is a safety link 9 that is provided on its outer contour with a tongue or side portion 13, and has a nose 14 directed toward the depth limiter 12. The height of the top cutting edge 11 determines a path 10, whereby the outer contour of the side portion 13 is disposed on the path 10, as is clearly shown in FIG. 1.

Figure 2:
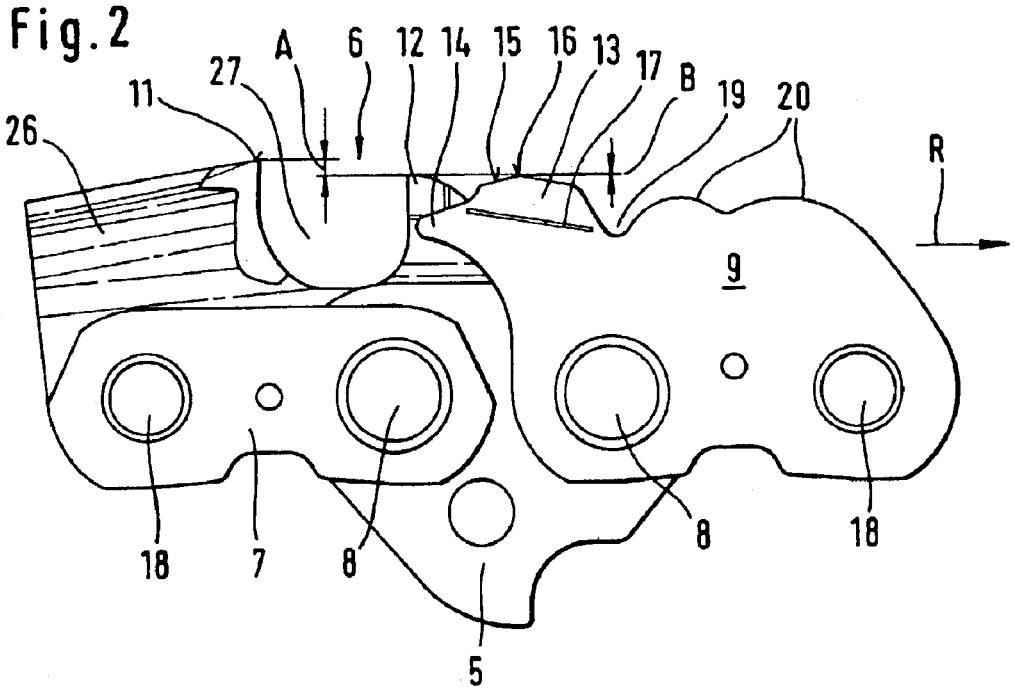
FIG. 2 is an enlarged illustration of one unit, comprised of a drive link, side link, cutter link and safety link, in the new state of the cutter and safety links.

FIG. 2 shows an enlarged illustration of one unit comprised of a drive link 5, a side link 7, a cutter link 6, and a safety link 9. The arrow R indicates the direction of travel. The rivets 8 and rivet receiving openings 18 coincide with those of FIG. 1. The cutter link 6 includes a cutter tooth 26, on the upper edge of which is disposed the top cutting edge 11. The depth limiter 12 is disposed ahead of the top cutting edge 11, in the direction of travel R, by a spacing determined by a recess 27 in the cutter link 6. The height of the depth limiter 12 is dimensioned such that its upper edge is disposed below the height of the top cutting edge 11 by a spacing A.

As further shown in FIG. 2, the safety link 9 includes the upwardly directed side portion 13 and the nose 14 that is directed toward the cutter link 6, whereby in the stretched position of the saw chain pursuant to the illustration in FIG. 2, the nose 14 comes to rest next to the depth limiter 12. Provided at the lower border of the side portion 13 is a marking or indicator 17. Disposed at the upper side of the side portion 13 is a contact surface 15, the front end of which, as viewed in the direction of travel R, is indicated by the reference numeral 16. In the stretched position of the saw chain, this end 16 of the contact surface 15 forms the highest point, which is disposed at least approximately at the same level as the highest point of the depth limiter 12, so that the spacing B between these two high points is practically zero. The embodiment of the cutter link 6 and of the safety link 9 shown in FIG. 2 corresponds to the new state of the chain, as is also illustrated in FIG. 1.

Figure 3:
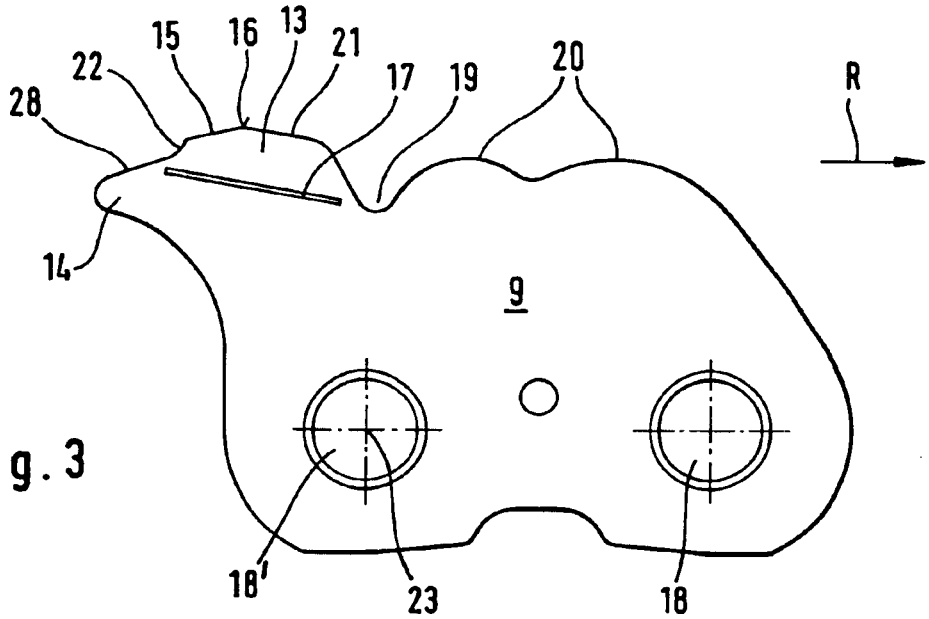
FIG. 3 is an enlarged illustration of an individual safety link.

FIG. 3 shows an enlarged illustration of an individual safety link 9. This safety link 9 has two rivet receiving openings 18 and 18' that are disposed one after the other at a specific spacing when viewed in the direction of travel R. The rear region of the safety link 9, again as viewed in the direction of travel R, is provided with an upper tongue or side portion 13, the lower border of which is delimited by the indicator 17. The upper side of the side portion 13 is formed by the contact surface 15 and a guide surface 21 that adjoins the end 16 of the contact surface. Provided ahead of the guide surface 15 as viewed in the direction of travel R is an indentation 19 that is disposed approximately above a center point 23 of the rear rivet receiving opening 18'. At the upper edge, in the region ahead of the indentation 19, the safety link 9 is embodied as a double hump 20.

Provided at the rear end of the safety link 9 is the nose 14, the upper side of which is delimited by a surface 28. Disposed between the contact surface 15 of the side portion 13, and the surface 28 of the nose 14, is a transition region 22 that drops off more steeply than does the contact surface 15, and that extends to the surface 28 in a curve. The indicator 17 extends, as a straight line, parallel to the guide surface 1.

Figure 4:
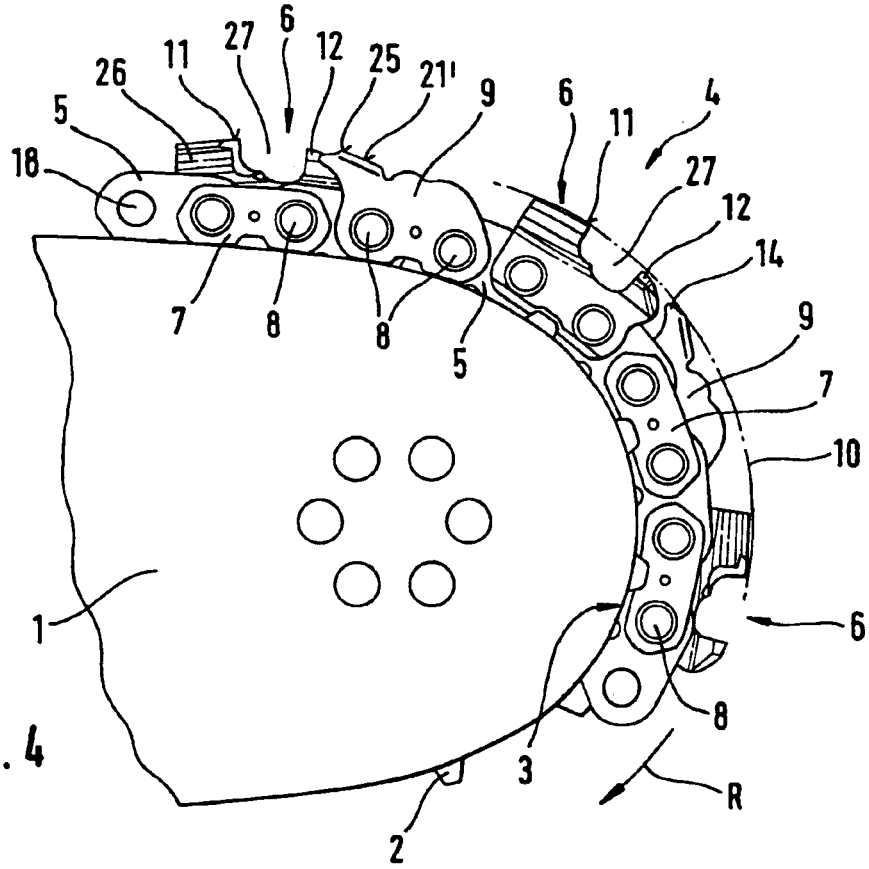
FIG. 4 is an illustration in accordance with FIG. 1 showing re-sharpened cutter and safety links.

FIG. 4 shows the front end of a guide bar 1 with a portion of a saw chain 4 that is guided thereover and essentially corresponds to the illustration of FIG. 1. Therefore, the same components have the same reference numerals as in the previously described figures. In contrast to FIG. 1, however, the cutter links 6 and safety links 9 in FIG. 4 are in a re-sharpened state, which is recognizable with the cutter link 6 due to the large spacing between the top cutting edge 11 and the depth limiter 12. With the safety link 9, the re-sharpened state can be recognized at the downwardly displaced guide surface 21, which due to appropriate ablation or removal is disposed closer to the indicator 17. If due to re-sharpening the guide surface 21 has approached the indicator 17 to such an extent, the side portion or tab 13 shown in FIG. 3 has nearly entirely disappeared. At the rear edge of the guide surface 21, there is then formed by the adjoining transition region 22 a peak or crown 25 that in the guide or reversing region projects somewhat beyond the path 10.

Figure 5:
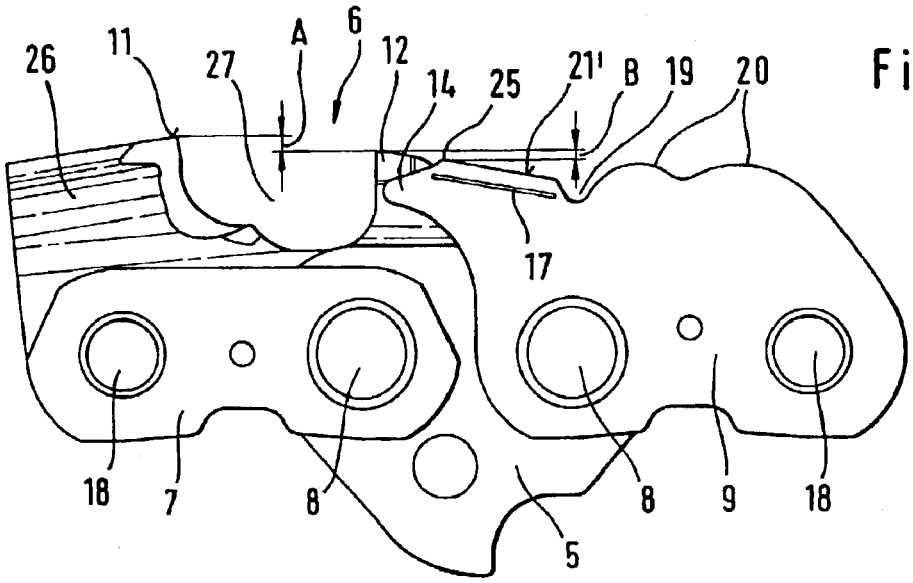
FIG. 5 is an illustration according to FIG. 2 in a state after a first re-sharpening.

FIG. 5 shows the unit of FIG. 2 in a state after about one third of the usable tooth length has been re-sharpened. It is clear from this illustration that the recess 27 in the cutter link 6 is considerably larger, and hence also the top cutting edge 11 on the cutter tooth 26 is recessed. In contrast to the new state, also the height of the depth limiter 12 is reduced, and the beginning of the top cutting edge 11 in FIG. 5 is lower than in the new state of the saw chain. The spacing A between the respective heights of the top cutting edge 11 and of the depth limiter 12 is therefore the same magnitude as in FIG. 2. As can furthermore be seen from FIG. 5, the side portion 13 from FIG. 3 is nearly entirely missing, so that the guide surface 21' is considerably more closer to the indicator 17. As a consequence of this shifting of the guide surface 21' to a lower level, there results between the highest point on the crown 25 and the highest level of the depth limiter 12 a recognizable spacing B. The remaining features coincide with those of FIG. 2, so that the reference numerals for the same components are identical.

Figure 6:
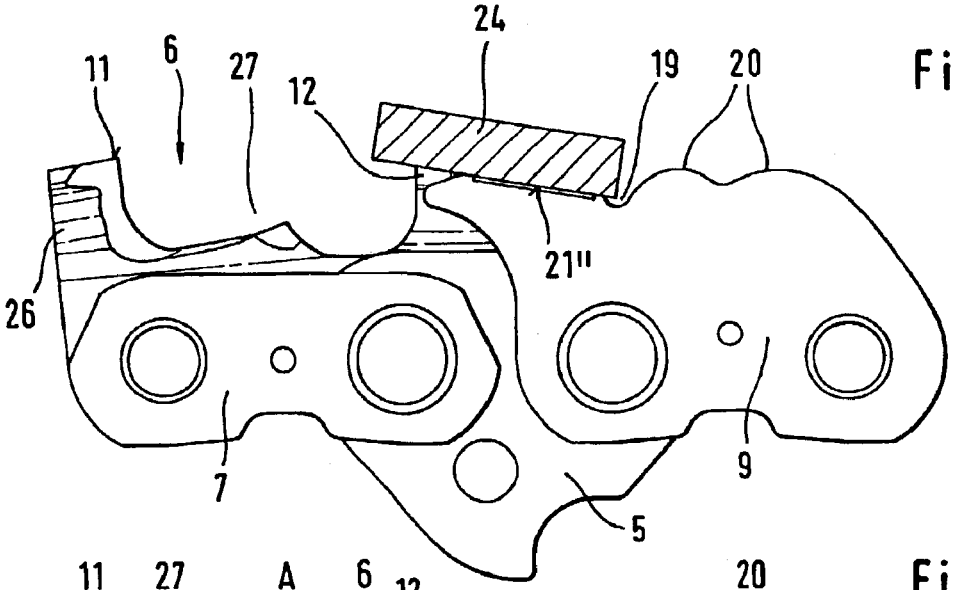
FIG. 6 shows a unit according to FIG. 2 in the re-sharpened state with a sharpening tool.

FIG. 6 shows the unit comprised of the drive link 5, the side link 7, the cutter link 6, and the safety link 9 in a further sharpened state with a sharpening tool in the form of a file 24 on the depth limiter 12 and the guide surface 21". FIG. 6 indicates the last sharpening state that can be carried out, since in this case the top cutting edge 11 is already displaced toward the rear by the maximum amount. As shown in FIG. 6, one edge of the file 24 is disposed in the region of the recess 19, so that the file can rest well upon the guide surface 21". The guide surface 21" and the upper edge of the depth limiter 12 are aligned with one another.

Figure 7:
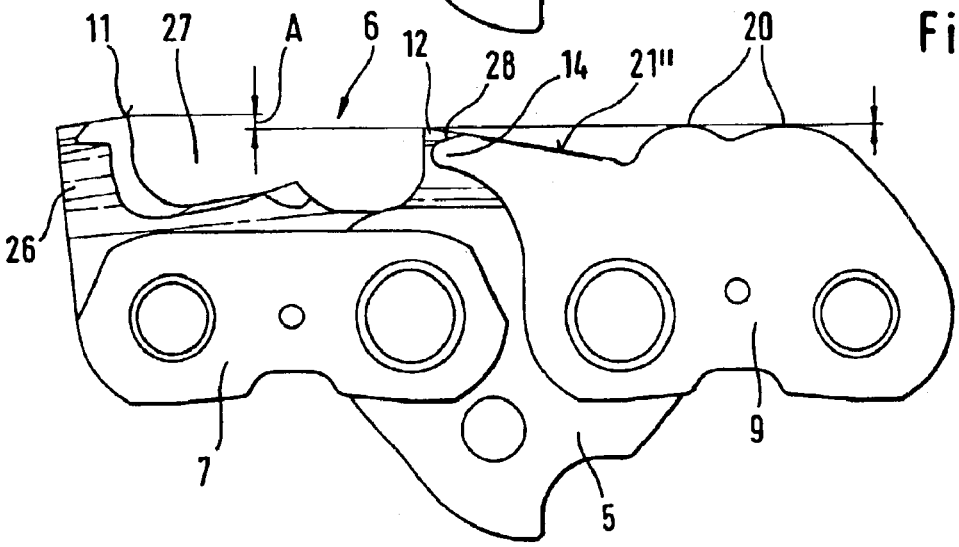
FIG. 7 shows a unit according to FIG. 5 in the last sharpened state.

This alignment of the upper edge of the depth limiter 12 and the guide surface 21" of the safety link 9 is also visible in FIG. 7, which also shows the unit in the state of the maximum re-sharpening. In this connection, the position of the guide surface 21" coincides with the previously present indicator 17, which is still visible in FIG. 5. In other words, it is also clear that upon reaching this indicator, no further re-sharpening is possible. FIG. 7 also shows that the spacing A between the height of the cutting edge 11 and the uppermost point of the depth limiter 12 is still constant, and that the uppermost point of the depth limiter 12 is disposed at the same level as the outer contour of the double hump 20.

Figure 8:
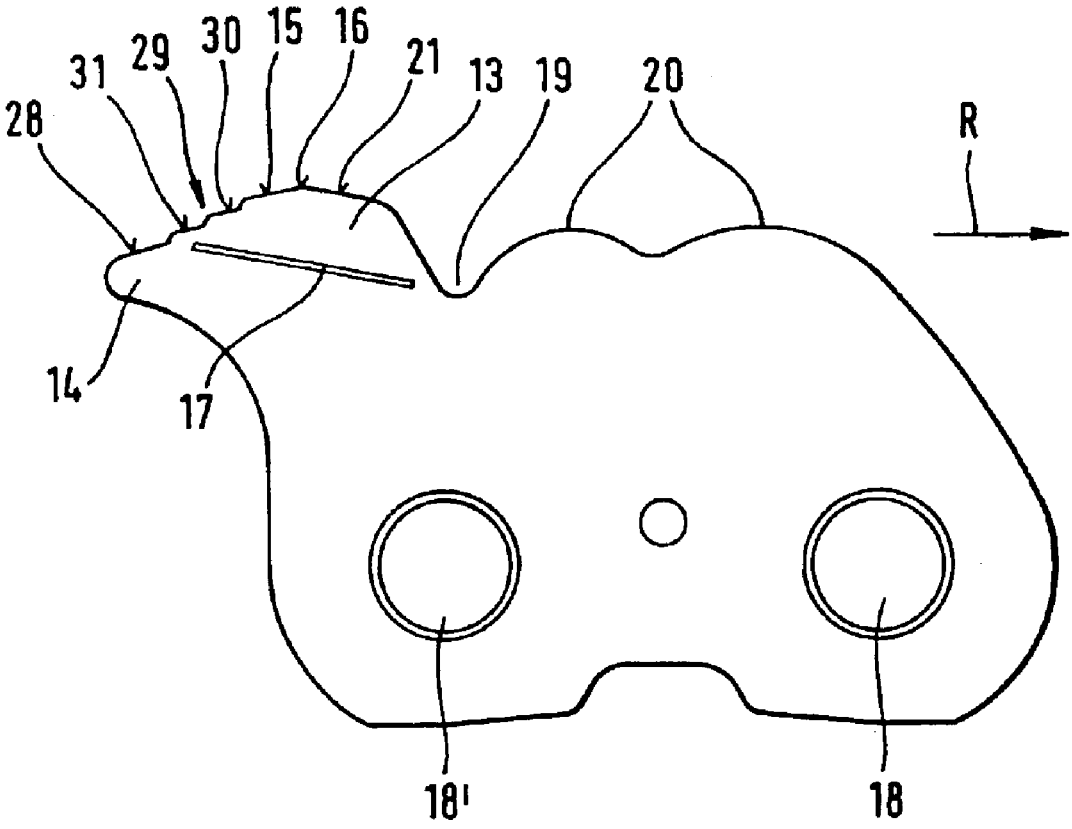
FIG. 8 shows a variation of the embodiment of FIG. 3.

FIG. 8 shows an enlarged illustration of an individual safety link 9 that has a different configuration than does the embodiment of FIG. 3 with respect to the transition region between the contact surface 15 and the surface 28 of the nose 14. In the embodiment shown in FIG. 8, there is provided between the contact surface 15 and the surface 28 a double-stepped transition region 29 that includes two steps 30 and 31 that respectively form contact surfaces at different levels. This arrangement has the advantage that as a consequence of the re-sharpening, the steps 30 and 31, depending upon the stage, successively serve as contact surfaces and hence provide a larger curved length contact surface than was the case in the embodiment of FIG. 3. In other respects, the reference numerals correspond for the same components.

As can be seen from the preceding description of FIGS. 1 to 8, with the inventive saw chain 4 there results three re-sharpening phases that are disposed between the new state of FIG. 2 and the final state of FIG. 7. The first phase includes the range of 0 to 18% usable tooth length in which the contact surface 15 is effective. The second phase includes the range of 19 to 36% of the usable tooth length in which the transition region 22 or 29 is effective. Due to the smaller contact surface of the embodiment in FIG. 5, the pointed crown 25 beyond the actual path 10 of the top cutting edge 11 compensates for the missing surface. In the embodiment of FIG. 8, in place of the crown there results a larger contact surface in the respective steps 30, 31 than in the previous embodiment. The third phase extends over the range of 37 to 100% of the usable tooth length. In this case, the surface 28 at the upper side of the nose 14 is effective as the contact surface (see FIG. 7).

Further embodiments relative to the shape of the side portion 13 and of the nose 14 are also possible. For example, the length of the contact surface 15 can be greater, as a result of which the indentation 19 would be disposed somewhat more forwardly. An increase in the height of the double hump 20 is also possible to a limited extent, whereby the forward hump could also project slightly beyond the rearward hump.

It has been shown that with a saw chain pursuant to the present invention the cutting results are good not only in the new state but also in the re-sharpened state, and in particular during plunging or cutting with the power chain saw the result is improved and handling of the power chain saw is facilitated.

The specification incorporates by reference the disclosure of German priority document 102 16 529.7 filed Apr. 15, 2002.

The present invention is, of course, in no way restricted to the specific disclosure of the specification and drawings, but also encompasses any modifications within the scope of the appended claims.

What is claim is:

1. A saw chain for a power chain saw, comprising:

drive links;

side links for connecting said drive links;

cutter links, each having a cutter tooth with a top cutting edge, and, in the direction of travel of said saw chain, a leading depth limiter, and safety links, wherein said cutter links and said safety links are alternatingly disposed on opposite longitudinal sides of said drive links in place of some of said side links, wherein each safety link is provided with a projecting nose that extends in a direction toward the depth limiter of a following cutter link, wherein each safety link is further provided with a side portion that in said direction of travel of said saw chain is disposed ahead of said nose, wherein said side portion has an elevated contact surface that, when said saw chain is curved in a reversing region is disposed on a path of said top cutting edge of said cutter tooth, wherein when said saw chain is extended said contact surface reaches at least nearly to a height of said depth limiter, wherein a transition region is disposed between said contact surface and said nose, and wherein said transition region includes at least two steps that act as contact surfaces in a re-sharpened state of said safety link.

2. A saw chain according to claim 1, wherein when said saw chain is in a curved state, at least nearly an entire length of said contact surface is disposed on said path of said top cutting edge.

3. A saw chain according to claim 1, wherein when said saw chain is extended, a front end of said contact surface, as viewed in said direction of travel, is disposed at the same level as said depth limiter.

4. A saw chain according to claim 1, wherein an upper surface of said nose is delimited by a surface that in a re-sharpened state of a safety link acts as a contact surface and is disposed upon said path of said top cutting edge.

5. A saw chin according to claim 1, wherein a guide surface for a re-sharpening tool is provided on said side portion ahead of said contact surface as viewed in said direction of travel.

6. A saw chain according to claim 5, wherein a contour of said contact surface is conformable via a re-sharpening of said depth limiter.

7. A saw chain according to claim 5, wherein an indentation is provided ahead of said guide surface when viewed in the direction of travel.

8. A saw chain according to claim 7, wherein in a longitudinal direction of said safety link, said indentation is disposed approximately over a center point of a rear rivet receiving opening of said safety link.

9. A saw chain according to claim 7, wherein ahead of said indentation, as viewed in said direction of travel, an upper contour of said safety link is embodied as a double hump.

10. A saw chain for a power chain saw, comprising:

drive links;

side links for connecting said drive links;

cutter links, each having a cutter tooth with a too cutting edge, and, in the direction of travel of said saw chain a leading depth limiter;

safety links, wherein said cutter links and said safety links are alternatingly disposed on opposite longitudinal sides of said drive links in discs of some of said side links, wherein each safe link is provided with a projecting nose that extends in a direction toward the depth limiter of a following cutter link, wherein each safety link is further provided with a side portion that in said direction of travel of said saw chain is disposed ahead of said nose, wherein said side portion has a contact surface that is elevated relative to said nose, extends from said nose, and that, when said saw chain is curved in a reversing region, is disposed on a oath of said top cutting edge of said cutter tooth, and wherein when said saw chain is extended, said contact surface reaches at least nearly to a height of said depth limiter; and at least one indicator is disposed in the region of side portion.

11. A saw chain according to claim 10, wherein said indicator is provided on a lower border of said side portion.

12. A saw chain according to claim 10, wherein said indicator is embodied as a line that extends parallel to a guide surface that is provided on said side portion ahead of said contact surface when viewed in said direction of travel.

13. A saw chain according to claim 10, wherein said indicator is embodied in a relief manner in material of said safety link.

14. A saw chain according to claim 10 wherein a transition region is disposed between said contact surface and said nose.

15. A saw chain according to claim 14, wherein said transition region includes at least two steps that act as contact surfaces in a re-sharpened state of said safety link.

* * * * *